United States Patent [19]

Instone et al.

[11] Patent Number: 4,674,645

[45] Date of Patent: Jun. 23, 1987

[54] GARMENT FREIGHT CONTAINER

[75] Inventors: Giles A. Instone; Michael V. Rule, both of London, England; Ronald E. van Riemsdijk, Rotterdam, Netherlands

[73] Assignee: Solindo Equipment Leasing Limited, London, England

[21] Appl. No.: 698,315

[22] Filed: Feb. 5, 1985

[51] Int. Cl.[4] ..... B65D 88/00

[52] U.S. Cl. ..... 220/1.5; 220/71; 220/72; 206/278; 206/288; 206/290; 206/600; 296/222

[58] Field of Search ..... 206/278, 288, 289, 290, 206/600; 220/1.5, 71, 72, 331, 345, 349; 312/184; 296/26, 181, 205, 218, 216, 222; 52/66, 70

[56] References Cited

U.S. PATENT DOCUMENTS

| | | | |
|---|---|---|---|
| 1,130,242 | 3/1915 | Scheuch | 206/289 |
| 2,036,346 | 4/1936 | Meyer | 206/289 |
| 2,893,588 | 7/1959 | Martin | 206/599 |
| 3,001,662 | 9/1961 | Herpich | 220/1.5 |
| 3,044,656 | 7/1962 | Combs et al. | 220/1.5 |
| 3,074,538 | 1/1963 | Belsinger | 206/290 |
| 3,655,087 | 4/1972 | Luisada | 220/1.5 |
| 3,796,342 | 3/1974 | Sanders et al. | 220/1.5 |
| 3,828,964 | 8/1974 | Bonnot | 206/600 |
| 3,853,238 | 12/1974 | Luisada et al. | 220/1.5 |
| 3,955,700 | 5/1976 | Pedraza | 220/1.5 |
| 3,968,895 | 7/1976 | Barnes et al. | 220/1.5 |
| 4,009,796 | 3/1977 | Schmidt | 220/345 |
| 4,035,964 | 7/1977 | Robinson | 52/70 |
| 4,091,950 | 5/1978 | Crauen | 220/1.5 |
| 4,270,657 | 6/1981 | Bayon | 206/386 |
| 4,275,920 | 6/1981 | Pohl | 296/222 |
| 4,293,076 | 10/1981 | Collin | 206/289 |
| 4,355,723 | 10/1982 | Loeber | 206/599 |
| 4,418,968 | 12/1983 | Johannes | 312/184 |

FOREIGN PATENT DOCUMENTS

| | | |
|---|---|---|
| 1507042 | 4/1978 | United Kingdom . |

*Primary Examiner*—William Price
*Assistant Examiner*—David T. Fidei
*Attorney, Agent, or Firm*—Willian Brinks Olds

[57] ABSTRACT

A collapsible container for suspended freight, especially for conveying garments by air, the walls and roof being of rigid waterproof panels supported upon a standard floor pallet. In the preferred case, the roof slides on rollers over two opposite side walls and is provided with parallel horizontal bars rigidly attached to its inner surface for the suspension of the garments. The weight carried by the side walls is distributed over the floor pallet by supporting the side walls on a weight distributing framework. The component panels may be separated for return flights and stacked horizontally to save space.

5 Claims, 6 Drawing Figures

GARMENT FREIGHT CONTAINER

BACKGROUND OF THE INVENTION

The present invention relates to a freight container more particularly for use in aircraft. Freight containers for aircraft require to be supported upon floor pallets which are of a standard construction and floor area. The pallets may have cooperating means by which they may be secured to the aircraft floor and they are normally provided around an upper margin area with a row of sockets or other such means by which straps or nets stretched over the container may be secured in place so that the container is immovable in flight. Similar provisions apply or may apply in the future in other freight transporting vehicles or vessels.

In a known form of container the pallet itself constitutes the floor, the pre-assembled walls and roof being placed over the pallet. In such a container an end wall is normally left open while loose freight e.g. in the form of cartons is stacked within the container on the pallet floor after which the end wall is locked in place. Thereafter the container may be secured to the pallet by straps or nets attached by locking into the peripheral pallet sockets.

Since the load is directly supported upon the pallet, the construction may be of lightweight panels, e.g., of aluminium alloy or an aluminium framework over which is stretched a fabric tent.

Loading freight upon a floor area is suitable for many types of freight but normally requires such freight to be prepacked in cartons so that the goods underneath are not damaged by the weight of the goods above. This is unsuitable or undesirable for certain types of freight particularly garments which require to be suspended on hangers. However, other types of freight are particularly adapted for packing in suspended form, e.g., carcases. Other types of freight would be suitable for packing by suspension if suitable means were available, possible examples being flowers, fruit and mailbags. Such an option would allow for a greater measure of security against damage and lighter weight wrapping.

Up to the present, the carrying of freight by suspension has not attracted notice because of the lack of any suitable container. The only known container suitable for suspended garments is of framework and tent construction with provision for the insertion of horizontal bars between opposite end walls. This has been found generally unsatisfactory for a number of reasons. The weight of freight which can be carried is very limited; there is insufficient protection for freight, notably garments. against weather conditions in periods when the container is exposed outside awaiting shipment; the use of removable elements such as bars means that these are frequently lost and the container is rendered unusable until further supplies are obtained; assembly and disassembly s inconvenient and time consuming; the construction does not provide the necessary confidence that when fully loaded it is secure against collapse under flight conditions.

There is consequently a serious need for a container for suspended freight which meets certain minimum standards, notably that the container is of collapsible construction to save space on return journeys; that the container may be packed to the available volume; it is strong and weather-proof; it is easily collapsed to a small volume to a small, recognisable number of units to avoid losses between voyages; the construction is such that it provides the necessary confidence to the user that it will protect the freight and will be secure against collapse during flight conditions.

SUMMARY OF THE INVENTION

According to the invention there is provided a collapsible container for suspended freight comprising two end walls, two side walls and a roof, each of the walls and roof being rigid waterproof panels, means for locking the walls together upon a standard floor pallet to form a rectangular enclosure of the required area, means enabling sliding manipulation of the roof into position over the enclosure, means restricting horizontal movement of the roof when in position, and means on the interior face of the roof enabling the suspension of freight, the roof and at least two opposite walls being of load supporting construction.

Preferably the sliding means include a roller adjacent corners of the roof at at least one end of the roof and positioned to engage with an upper edge surface of a side wall.

Waterproofing is preferably provided by water repelling interlocking surfaces on the roof and/or walls. This may be provided by the presence of flanges on the side edges of the roof dimensioned to receive edge portions of the side walls.

Horizontal movement of the roof when in position may be accomplished at least partly by locating rollers (at one or both ends) in roof portions which project downwardly at each end from a central side edge section and providing the side walls with cooperating recessed shoulders at each end. Preferably the end walls extend above the level of the shoulders to partly enclose the rollers. The shoulders are preferably recessed to an extent such that substantially all roof weight is borne by central portions of the side walls. Such shoulders are preferably joined to the central portions by inclined edge portions which allow the rollers to ride up onto the central portions during assembly.

All of the walls may be supported directly upon the pallet. However, this gives rise to a particular disadvantage which will be explained hereafter and seriously limits the total weight of freight which may satisfactorily be packed. According to an important preferred feature of the invention the container is inclusive of a rigid weight distributing framework which overlies the pallet. The side walls may then be supported directly on the framework, rather than the pallet floor thereby distributing the load evenly across the pallet floor. This may be accomplished by distributed framework engaging bracket inset from the lower edges of the side walls.

The suspension means preferably include parallel spaced horizontal suspension bars attached to the roof. The suspension bars preferably extend parallel to the end walls and may be rigidly connected to the roof by end brackets and intermediate load supporting struts which may constitute a part of the roof framework.

According to another aspect of the invention there is provided a collapsible container for suspended freight adapted to be assembled upon an aircraft pallet and including side walls and end walls lockable together and a roof, formed with weight supporting suspension means and a weight distributing framework resting on the pallet, wherein the roof is arranged to be supported on the side walls only, the side walls being supported in turn upon the framework.

An embodiment of the invention is hereinafter described with reference to the accompanying drawings in which:

DETAILED DESCRIPTION OF AN EMBODIMENT OF THE INVENTION

Figure 1:
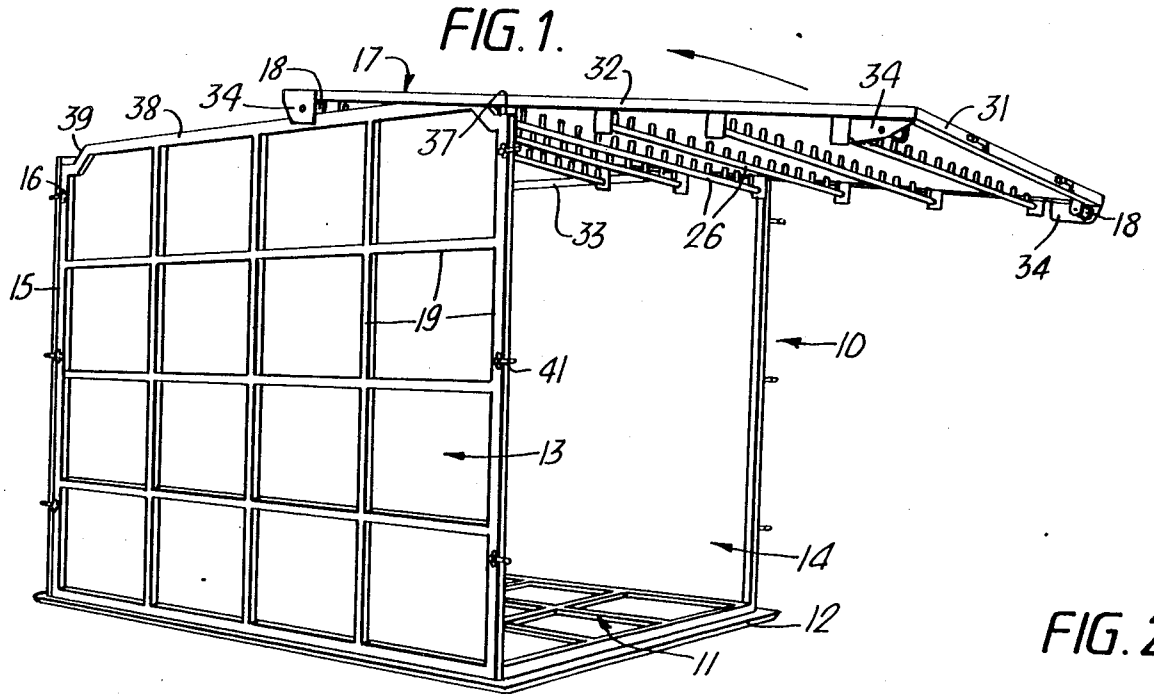
FIG. 1 is a perspective view of an assembled garment freight container in accordance with the invention showing the roof in the course of being slid into position.
Figure 2:
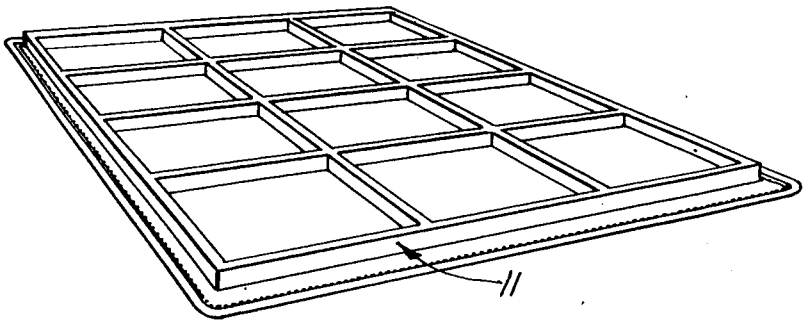
FIG. 2 is a perspective view of the pallet and floor frame.

Turning to FIG. 1 there is shown a garment freight container in accordance with the invention in the course of assembly. The container 10 comprises a floor frame 11 directly supported upon a pallet 12. Two opposite side walls 13, 14 are supported directly upon the floor frame 11 as described hereinafter. A rear wall 15 stands directly upon the pallet 12 and is locked to the side walls by locking means generally indicated at 16. A front wall not shown in the drawings is generally similar to the end wall 15 and is locked in place in the same way after the freight has been loaded.

In FIG. 1 the two side walls and rear wall are in place and a roof 17 is in the course of being moved into its assembled position by sliding manipulation. For this purpose the roof is provided with four rollers 18 of rigid nylon one of which is indicated in FIG. 1 in engagement with the upper edge surface of side wall 13. Similar rollers 18 are provided in the other corners of the roof 17.

The side walls 13 and 14 are composed of a load supporting framework 19 of extruded box sectioned aluminium or alloy to which are secured panels preferably of lightweight metal such as aluminium to provide a waterproof inner skin. The provision of the panels on the interior provides greater protection against damage. An exterior skin may be provided if desired. The end walls are preferably of similar construction although in the present embodiment the framework need not be of load supporting construction. The roof is of generally similar construction as will become apparent and the floor frame 11 is constructed similarly. The extruded bars of these frames may be welded together and the panels secured by rivetting or welding.

Figure 3:
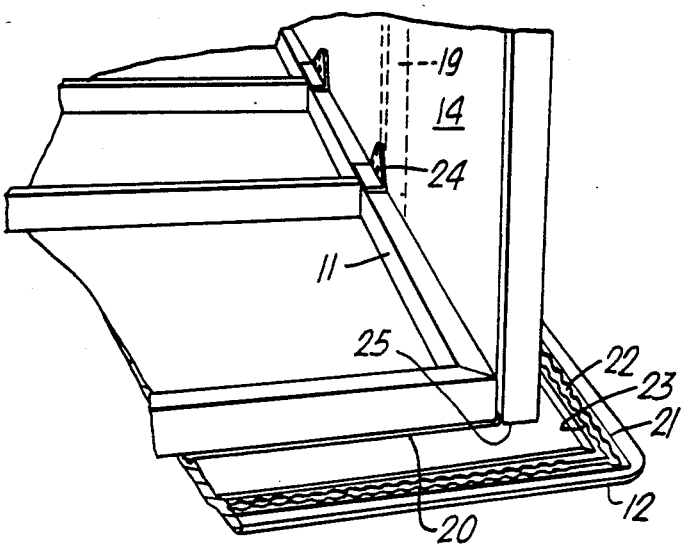
FIG. 3 is a fragmentary perspective view showing placement of a side wall in position.

As shown more particularly in FIG. 3, the pallet 12 is of a standard construction and floor area defined by a raised ridge 20 and the periphery of the floor frame 11 is designed to engage immediately against the ridge 20. Around the ridge 20 is a margin area which includes a raised section 21 formed with a line of sockets 22 and interconnecting slots 23. The sockets and slots allow the engagement of locking means attached to standard straps or nets which secure the assembled container to the pallet. As shown also in FIG. 3, the side wall 14 is provided with distributed framework engaging brackets 24 secured e.g. by rivetting to part of the framework 19 of that side wall. These rest upon the floor frame 11 and are inset from the lower edges of the side walls by a sufficient distance that the edge of the side wall as indicated at 25 is clear of the pallet 12, so that the load which is supported via the side walls is distributed over the whole area of the floor frame 11.

Figure 4:
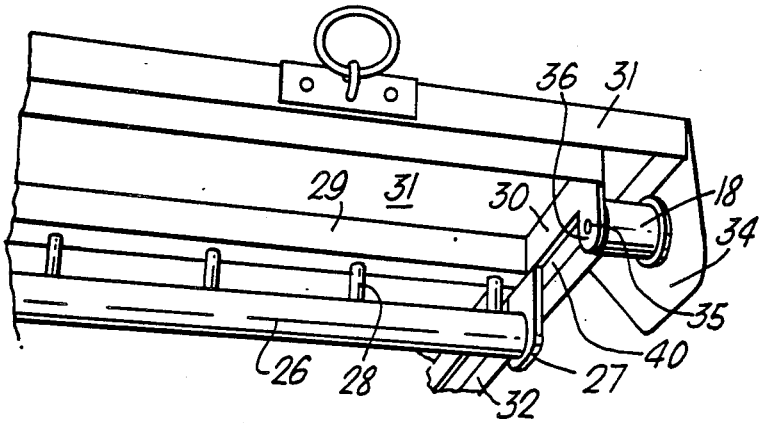
FIG. 4 is a fragmentary perspective view showing details of the roof construction.

According to an important feature of the invention the means for suspending the freight form an integral part of the roof which, like the side walls are of load supporting construction. The provision of the load supporting means on the interior face of the roof immediately avoids the necessity for removable supporting means such as bars. Details of the roof construction are given in FIGS. 1, 4 and 5. Parallel spaced horizontal suspension bars 26 extend parallel to the end walls and are rigidly connected to the roof by end brackets 27 and intermediate load supporting struts 28. The struts 28 are welded to the bars 26 at one end and to load supporting box sectioned aluminium or alloy extrusion girders 29 at the other end. The girders 29 are welded to side girders 30 extending the length of the roof which is provided with an exterior skin 31 of weatherproof panels similar to those of the walls. Garments or other freight may be suspended directly from the bars 26 or via intermediate straps e.g. provided with a row of eyelets. Such straps may be fitted during assembly and removed at the end of a voyage and if necessary replaced by fresh ones.

In the embodiment shown there are six horizontal bars 26 distributed along the length of the container and separated by a distance which allows convenient hanging of clothes upon garment hangers. The construction of the container and in particular the roof and side walls and floor frame is sufficiently strong that the container may be packed by volume capacity with clothes without exceeding the load specification.

It is another important feature of the invention that the roof can be moved into a "locked" assembled position by manipulation and for this purpose the embodiment provides the rollers 18 in the four corners. The mounting of these rollers is shown particularly in FIGS. 4 and 5. A continuous exterior flange extends around the roof for weatherproofing purposes. This flange has a front portion 31, a similar rear portion (not shown) and side portions 32, 33. The side flange portions have enlarged portions one of which is shown at 34 which act as bearing surfaces for the axle 35 of each roller. The opposite end of the axle 35 is secured to a bracket 36 welded to roof side frame member 30.

It will be observed that the rollers are positioned so that they extend below the level of flange portions 32 and provide a means of restricting horizontal movement of the roof when in position. As shown most clearly in FIG. 5, the side walls 13, 14 have recessed shoulders 37 at each end. The shoulders 37 are joined to central portions 38 of the side walls by inclined edge portions 39.

Figure 5:
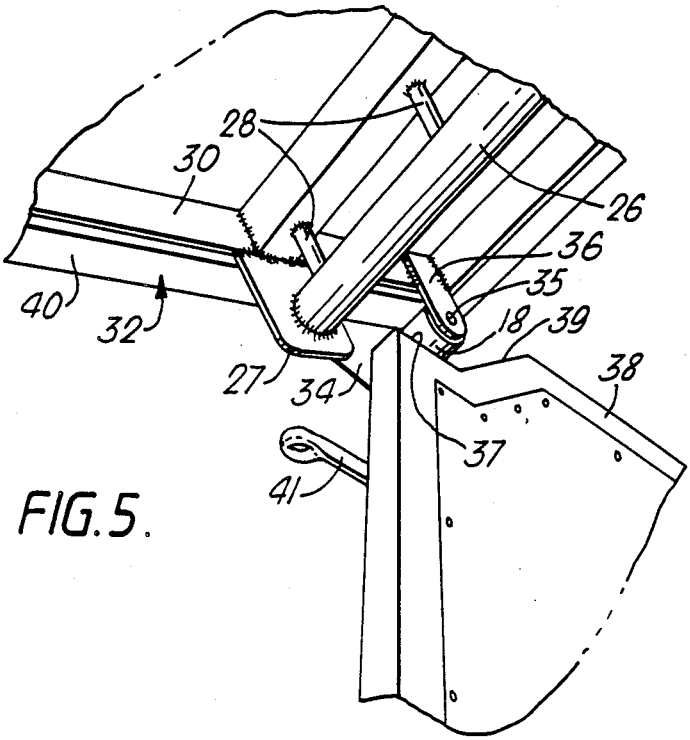
FIG. 5 is a fragmentary perspective view showing the engagement of the roof roller with a recessed shoulder of a side wall.

FIG. 5 illustrates the roof in its initial position before being manipulated into the end position. It will be seen that a roller 18 rests upon a shoulder 37 on each side. The roof may be pushed so that the roller 18 engages an inclined edge portion 39 up which it can ride over onto a central edge portion 38 and thence across the length of the container until it rides down the opposite inclined portion 39. At this point the roof drops into place and the bottom surface 40 of roof side girder 32 falls into engagement with edge 38 on each side. In this end position the weight of the roof and its load is taken off the rollers although these may be in light engagement with the shoulders 37 to further resist horizontal movement of the roof.

Although four rollers are shown in the embodiment, this is for convenience, enabling the roof to have lateral symmetry so that it can be manipulated into place from either side in either orientation. One pair of rollers takes no part in the manipulation into position and may be replaced by some form of abutment means preventing horizontal movement. It may be provided with a frictional lower surface for engaging shoulder 37 to further restrict horizontal movement.

It will be observed in FIG. 1 that the end walls stand proud above the level of shoulders 37 and constitute the additional means for restricting horizontal movement of the roof when in position. Thus the rollers are confined within a generally U-shaped recess defined by the end walls, the inclined walls 39 and the shoulders 37.

The continuous flange around the roof provides an efficient water seal against the ingress of rain. When the roof is in position, the freight may be loaded and then the front end wall inserted into position. This is accomplished by inserting the upper edge of the front wall under the front flange 31 and lifting and pushing it into place.

Sealing means such as resilient strips e.g. of rubber may be provided between interengaging surfaces of the various components. Thus, they may be provided under the interior surfaces of the roof edge and/or the upper edges of the walls and the long upright edges of the walls. Preferably they have sufficient resilience that when the locking means is fully engaged they are compressed to form a weather-tight seal. The lower edges of the end walls may be provided with resilient sealing means and also the interior bottom edges of the side walls and/or the periphery of the floor frame 11.

Figure 6:
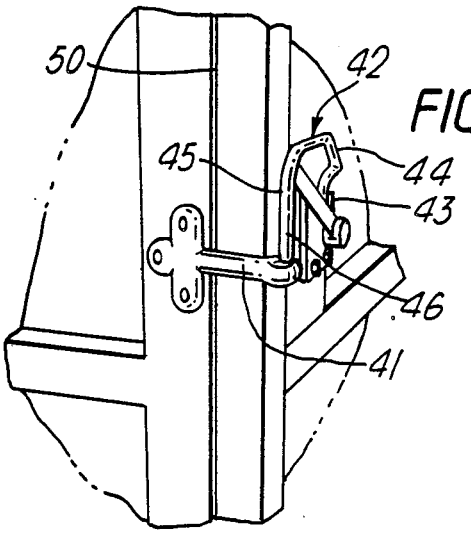
FIG. 6 is a fragmentary perspective view illustrating one of the locking means.

A preferred form of locking means is shown in FIG. 6 between two inter-engaging walls. The side walls are provided with projecting socket members 41 and the end walls with rotable hook members 42 on mounting plates 43 which are welded in place to the end wall framework. The hook members 42 have handle portions 44 and hook portions 45 which are stressed so that when engaged within the socket of member 41 they willd raw that member towards the right as shown in FIG. 6, compressing the resilient means 50 in position between the wall members. The hook portions 45 are provided with bores 46 through which may be inserted a padlock bar or ring for security.

Various modifications may be made within the scope of the claims, some of which have already been mentioned. If only one pair of rollers is provided, then recessed shoulders need only be provided at one end. The roof weight may be supported on all of the walls, in which case it is preferable that all of the walls should rest upon a floor frame for weight distribution. If, for example, the front wall is formed without a recessed shoulder and rests upon the pallet, then its upper edge should preferably be clear of the roof so that it does not support the weight.

The provision of the floor frame 11 has an important unexpected advantage. The pallet is constructed of sufficient strength to support the load when assembled upon any floor e.g. the aircraft floor. However, during the time that the loaded container is being manipulated into position, the pallet rests upon rollers and is engaged at central points by a driven roller or wheel. It has been found that unless the weight is evenly distributed, the driven roller or wheel does not come into frictional engagement with the underside of the pallet, making it impossible to load the container by mechanical means if loaded beyond a certain point.

We claim:

1. A collapsible container for suspended freight comprising two end walls, two side walls and a roof, each of the walls and roof being rigid waterproof panels, means for locking the walls together upon a standard floor pallet to form a rectangular enclosure of the required area, a pair of rollers located in roof portions which depend from opposite sides of one end of the roof, the side walls each having an upper edge with an elongated central portion and a recessed shoulder formed at an end of said upper edge, said rollers being received in a respective shoulder recess upon assembly of said container when said roof is moved along said side wall central portions on said rollers to locate said rollers adjacent said shoulders, and means on the interior face of the roof enabling the suspension of freight, the roof and at least two opposite walls being of load supporting construction.

2. A container according to claim 1 wherein the said shoulders are recessed to an extent that substantially all roof weight is borne by central portions of the side walls.

3. A container according to claim 1 or claim 2 wherein the said shoulders are joined to the said central portions by inclined edge portions.

4. A container according to claim 1 or claim 2 wherein the rollers are mounted in flange portions which overlap the respective side walls below the said shoulders.

5. A container according to claim 1 or claim 2 wherein the end walls extend above the level of the said shoulders and engage within flanges adjacent the end edges of the roof.

* * * * *